United States Patent [19]

Komada et al.

[11] Patent Number: 4,583,230

[45] Date of Patent: Apr. 15, 1986

[54] APPARATUS FOR INDUCTION HEATING OF MOLTEN METAL

[75] Inventors: Tadayuki Komada; Masahiko Seki; Yoshiyuki Inoshita, all of Fukuoka, Japan

[73] Assignee: Nippon Steel Corporation, Tokyo, Japan

[21] Appl. No.: 647,700

[22] Filed: Sep. 6, 1984

[30] Foreign Application Priority Data

Sep. 9, 1983 [JP] Japan ..... 58-166153

[51] Int. Cl.[4] ..... F27D 1/00

[52] U.S. Cl. ..... 373/156

[58] Field of Search ..... 373/151-158, 373/138, 143; 266/275, 276, 245

[56] References Cited

U.S. PATENT DOCUMENTS

| | | | |
|---|---|---|---|
| 1,694,791 | 12/1928 | Northrup | 373/152 |
| 3,303,259 | 2/1967 | Junker | 373/151 |
| 3,687,437 | 8/1972 | Fischer | 373/155 X |
| 3,944,715 | 3/1976 | Hegewaldt et al. | 373/153 |
| 4,123,045 | 10/1978 | Michelet et al. | 266/275 |
| 4,411,412 | 10/1983 | Lechevallier | 373/154 |

*Primary Examiner*—Roy N. Envall, Jr.

*Attorney, Agent, or Firm*—Cushman, Darby & Cushman

[57] ABSTRACT

The disclosed induction heating apparatus comprises: a refractory vessel in which a charge to be heated is placed; said vessel comprising a refractory lining and an outer shell covering the refractory lining and having strength high enough to sustain the lining; an induction heating coil arranged spacedly around the outer circumference of said shell; and a bottom outer shell covering the bottom of said refractory lining, said outer shell whose outer diameter is, at a position below the upper end of said coil, smaller than the inner diameter of said coil so as to enable the removal of said vessel through the upper side of said coil, at least part of said outer shell covering a height of the circumferential surface of said vessel corresponding to the height of said coil being made of a non-magnetic material, and said bottom outer shell being made of metal.

7 Claims, 9 Drawing Figures

APPARATUS FOR INDUCTION HEATING OF MOLTEN METAL

BACKGROUND OF THE INVENTION

1. Field of the Invention

The present invention relates to an apparatus for electric induction heating of molten metal, which is designed to perform various types of metallurgical treatments including melting and heating of varied ferrous alloys and non-ferrous alloys.

2. Description of the Prior Arts

Conventional ladle-type furnaces for high-frequency or low-frequency coreless-type induction heating for metallurgical treatments of metals are structured such that an induction coil is arranged around the outer circumference of a refractory vessel in which molten metal is held. A yoke is provided outside the coil and the unit of these components is reinforced by an outer frame structure. The furnace and the coil are inseparably assembled so that each vessel is required to have its own coil incorporated therein. Therefore, at least two furnaces are required for successive operations; one for the actual operation and the other for repairation of the linings. This naturally leads to economical disadvantages.

In order to eliminate the economical disadvantages, it may be considered that the coil is evenly spaced in an arrangement around the outer shell of the furnace. For this purpose, however, it is necessary that the outer shell of the furnace is made of steel, or some other metal frame structure is used for the required strength.

This metal frame structure, or a steel or metal shell when arranged inside the coil, generates an induction current which causes a great heat loss hence markedly damaging the electrical efficiency in induction heating of the metal disposed at the center of the coil.

As a method for overcoming the above disadvantage, Japanese Laid-Open Patent Specification Sho No. 53-88603 discloses an arrangement of non-magnetic and non-oxidizable steel beams in the form of parallel pillars to function as a frame structure. This proposed structure is favorable in some respects, but in terms of its over-all efficiency, there is still room for improvement. Also, the structure is not a completely closed system, thus failing to function as a vacuum system.

When the induction heating is desired under a vacuum, it is theoretically prohibited to apply a voltage of 240 V or higher under a high degree of the vacuum according to Paschen's Law, etc. concerning the relation between the gas pressure and the atmosphere-insulated voltage to be applied.

Therefore, in order to apply a voltage of 240 V or higher in this case, there is no way but to increase the coil current, which is also limited due to the coil shape and other factors. In practical operations of induction heating, the problem has been that this vacuum discharge hinders the application of a high voltage required by the heating capacity necessary for practical operations. The application of excessive voltages would create the danger of breaking the insulation during charging or the danger of short-circuiting.

For the reasons mentioned above, it is strongly desired to perform the induction heating outside the vacuum atmosphere in which the charge is disposed, by arranging the coil outside the vacuum atmosphere and placing the furnace and charged metal under the vacuum atmosphere.

However, when the furnace is reinforced with a metal shell, etc. selected depending on the strength of the furnace required under the vacuum atmosphere, the magnetic flux is shielded by the metal shell so that the charge cannot be satisfactorily heated. Also when the furnace is made of non-magnetic materials, such as ordinary refractories, and heat-insulating materials, the desired air-tightness cannot be assured and the strength as required by a ladle cannot be maintained.

SUMMARY OF THE INVENTION

The present inventors have paid attention to the fact that the middle cylindrical portion of the vessel or furnace surrounded by the coil, particularly, is required to have a certain degree of air-tightness and strength. On the basis of this fact, the present invention is to provide an induction heating apparatus which has a very high practical advantage with respect to the air-tightness and mechanical strength for practical services. According to the present invention, non-magnetic materials having satisfactory airtightness and mechanical strength are used for the middle cylindrical portion of the vessel or furnace surrounded by the coil and the bottom and other portions inherently having satisfactory strength are applied with a metal shell.

The present invention provides an induction heating apparatus for achieving the above-mentioned objects, and more specifically provides an induction heating apparatus comprising a refractory vessel in which metal or charge to be heated is placed; an outer shell covering the outer surface of the vessel and having strength high enough to hold the vessel; and an induction heating coil arranged detachably around the outer circumference of the shell, characterized in that the outer diameter (d) of the shell at a position below the upper end of the coil is smaller than the inner diameter (D) of the coil so as to enable the removal of the vessel through the upper side of the coil. At least part of the outer shell covering the circumferential surface of the vessel corresponding to the height of the coil is made of a non-magnetic material, and the outer shell covering the bottom of the vessel is made of metal.

According to a modification of the present invention, the induction heating apparatus further comprises a vacuum hood detachably mounted on the upper end portion of the vessel.

According to a further modification of the present invention, the induction heating apparatus further comprises a lance for blowing gas or powder into the vessel through the upper portion thereof, and/or a tuyere provided through the wall of the vessel at a level below the molten bath surface contained therein for blowing gas or powder into the bath.

According to a preferable embodiment of the present invention, the height of the outer shell made of non-magnetic material covering the circumferential surface of the vessel is about 4 times the height of the induction coil surrounding the outer shell.

The present invention will be more clearly understood from the following description of the preferred embodiments with reference to the accompanying drawings.

BRIEF EXPLANATION OF THE DRAWINGS

2 and 7 show respectively another embodiment of the apparatus according to the present invention.

DETAILED DESCRIPTION OF THE PREFERRED EMBODIMENTS

Figure 1:
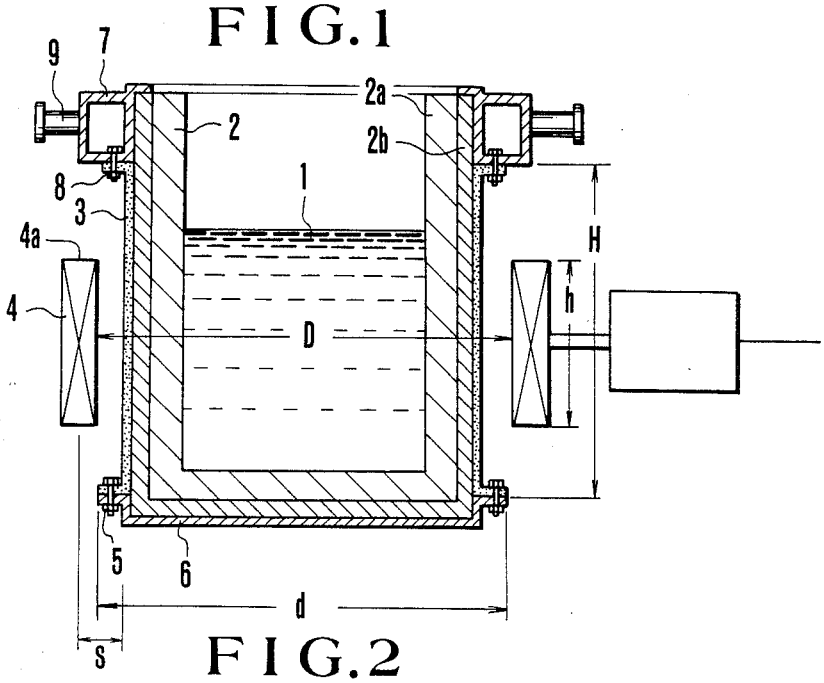
FIG. 1 shows a cross section of one embodiment of the apparatus according to the present invention. FIGS.

In FIG. 1 showing one embodiment of the present invention, the metal (charge to be heated or melted) is placed in a refractory vessel 2. The outer circumferential surface of the vessel is covered by a non-magnetic outer shell 3 made of a magnetic flux transmissible material, such as plastic reinforced with carbon fibres or glass fibres, or high-strength asbestos composite material.

Around the outer circumference of the non-magnetic outer shell 3, an induction coil 4 is spacedly arranged. The lower portion of the non-magnetic outer shell 3 is connected by a connecting means such as a bolt 5 to a bottom outer shell 6 made of non-magnetic steel, etc. so as to support the refractory vessel 2 containing the charge 1 therein.

On the other hand, the upper end of the non-magnetic shell 3 is assembled with an upper ring member 7 made of a metal such as copper and non-magnetic steel by means of a joint 8. The upper ring member 7 is usually equipped with a suspension member 9, such as a trunnion shaft and a suspension hook, by which the upper ring member 7, the non-magnetic outer shell 3, the bottom shell 6, and the refractory vessel 2 containing the charge 1, are lifted up all together through the induction coil 4.

For this purpose, all of the portion of the shell 3 below the upper end 4*a* of the coil, the bottom shell 6 and the connecting portion (connected by the bolt 5) have an outer diameter (d) smaller than the inner diameter (D) of the induction coil.

Regarding the height of the non-magnetic outer shell 3, it is desirable that the height (h) of the non-magnetic shell 3 is about 1 to 4 times the height (H) of the coil and that the coil is positioned around the middle portion of the shell. The height ratio, however, depends on the distance between the vessel and the coil and the strength of current applied to the coil. For illustration, in the case of a vessel of one ton (melt) capacity, the distance (S) between the vessel and the coil is 60 mm, the height (h) of the coil is 550 mm, the height (H) of the non-magnetic outer shell is 1,200 mm, thus H/h is 2.2. In the case of a vessel of 8 ton (melt), the distance (S) is 90 mm, the height (h) is 750 mm, the height (H) is 900 mm, thus H/h is 1.2. With this arrangement, the magnetic flux generated by the induction coil can efficiently penetrate the shell 3 and the vessel 2 to cause the induction heating of the charge 1 contained in the vessel. At a position remote from the upper or lower end of the coil 4 by 1.5 times or more of the coil height, the influence of the magnetic field is very weak and there is no substantial lowering of the electrical efficiency even if the shell is not made of a non-magnetic material at these remote portions, and there is no practical problem.

The refractory vessel 2 comprises a refractory layer 2*b* which comes in contact with the charge to be heated or melted and an insulating layer 2*b*, which is of such a heat insulating capacity that it can maintain the non-magnetic outer shell 3 below its maximum service temperature, for example, 150° C. in the event that the refractory layer 2*a* should be worn off.

As mentioned before, the non-magnetic outer shell 3 is made of magnetic flux transmissible materials, such as composite plastic materials, reinforced with carbon fibres or glass fibres, composite asbestos materials reinforced with cement etc. or ceramics so that the outer shell has a satisfactory heat resistance and strength.

The induction coil 4 is connected to a power source 5, adding an alternating current of low frequency or high frequency.

Figure 2:
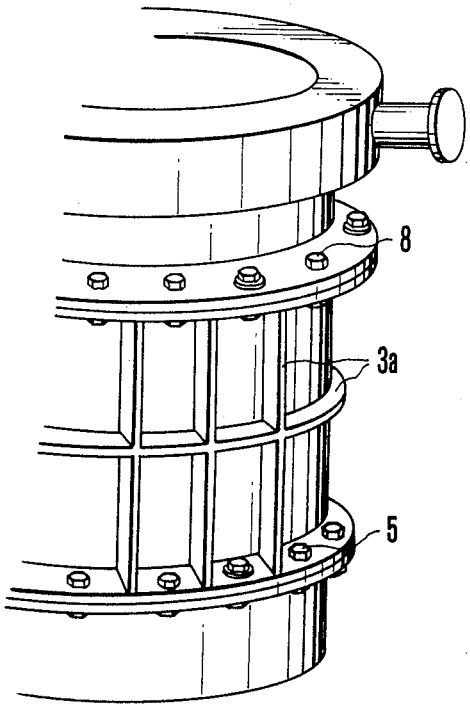

In FIG. 2, reinforcing ribs 3*a* are provided around the non-magnetic outer shell for increasing the strength thereof.

Figure 3:
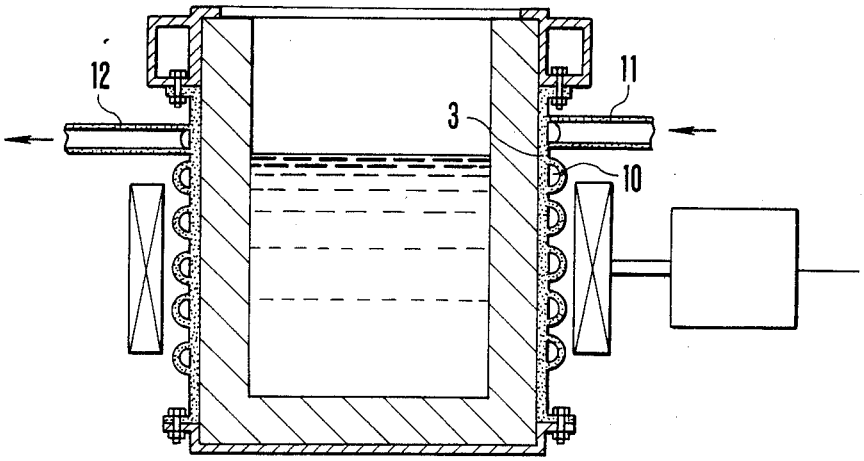
FIGS. 3, 4, 5 and 6 show the cross section of still another embodiment of the apparatus according to the present invention.

In FIG. 3 showing another embodiment of the present invention, a spiral conduit 10 is provided for flowing coolant around the non-magnetic outer shell 3 so as to prevent the deterioration and lowering in strength of the non-magnetic outer shell 3 due to the heat transmitted from the refractory vessel. The coolant is supplied through a coolant supply pipe 11 and discharged through a discharge pipe 12. As the coolant, water or gas such as air is usually used.

Figure 4:
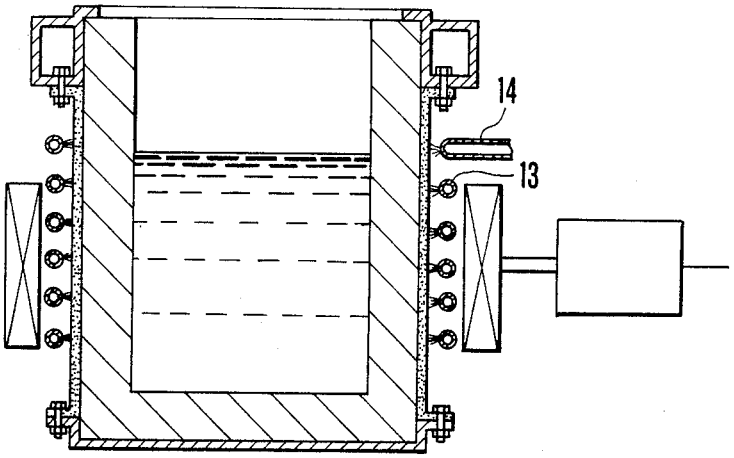

FIG. 4 shows another embodiment for cooling the non-magnetic outer shell 3, where a non-magnetic spiral pipe 13 is spaced in an arrangement around the outer shell 3 in an annular space formed between the non-magnetic outer shell 3 and the coil 4, so as to blow coolant on the outer shell 3 through nozzle opening 14 of the pipe 13. In this embodiment also, the coolant may be water or gas, such as air, and is supplied through a supply pipe 14.

Figure 5:
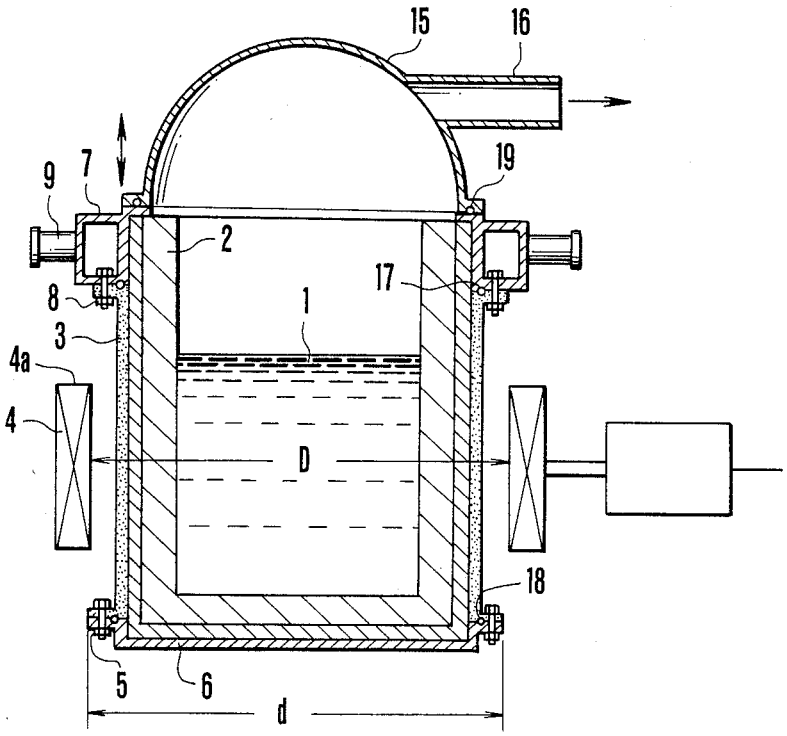

FIG. 5 shows a modification of the present invention, where an upper ring member 7 is provided around the upper portion of the outer shell 3 and a vacuum hood 15 is mounted over the outer shell 3. The vacuum hood is equipped with a vacuum exhaust pipe 16 with one end opening to the inside of the hood and the other end connected to a vacuum pump (not shown).

Again in this case the outer shell 3 is made of magnetic flux transmissible and air-tight materials, such as plastics reinforced with carbon fibres or glass fibres, high strength composite asbestos materials and ceramics. The upper end of the outer shell is assembled with the upper ring member 7 with a seal member 17, such as an O-ring inserted therebetween, so as to provide a sealing effect against the vacuum. The lower end of the outer shell 3 is assembled with the bottom shell 6 having a sealing member 18 such as an O-ring inserted therebetween to provide a similar sealing effect.

Also between the upper ring member 7 and the vacuum hood 15 is inserted a sealing member 19 to seal the contact portion between the hood 15 and the upper ring member 7.

The vacuum hood 15 is movable in both vertical and horizontal directions with respect to the vessel 2 (ladle). Also, when the vessel is used for vacuum treatments, a vacuum sealing structure is provided by the hood mounted on the upper portion of the vessel 2 in cooperation with the sealing member 19.

With the structure as described above, it is possible to apply induction heating to the charge under the vacuum without the necessity of arranging the coil under a vacuum atmosphere, and hence it is possible to apply a large electrical power without restriction due to the coil voltage, and in addition, the vessel has a high level of strength so that the apparatus can be used as a large ladle unit of 300 ton class. Therefore, the embodiment of the above structure has highly practical advantages.

Figure 6:
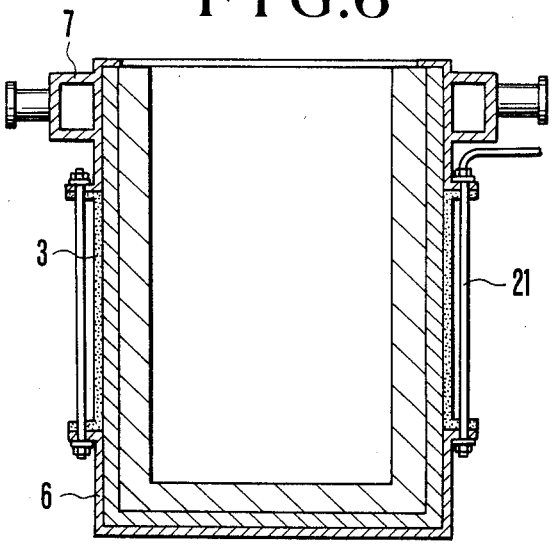
Figure 7:
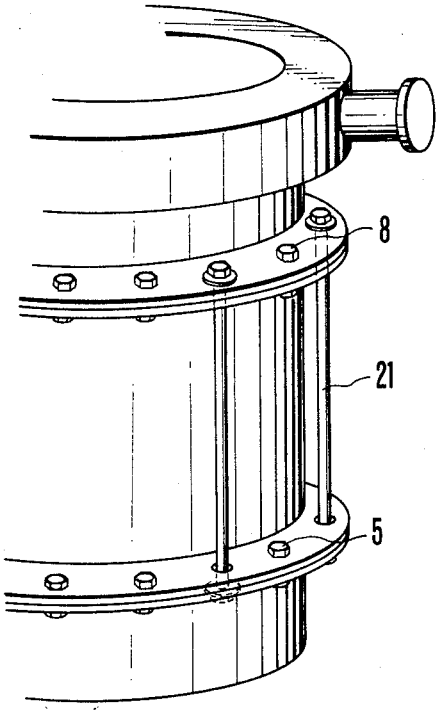
Figure 8:
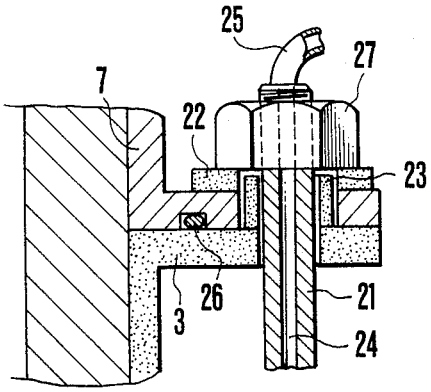
FIG. 8 shows, in detail, the connecting portion of the embodiments of the apparatus according to the present invention.

FIGS. 6, 7 and 8 show another modification of the present invention, where connecting rods 21 are provided to connect the upper ring member 7 and the bottom outer shell 6 while the outer shell 3 held therebetween so as to improve the strength of the non-magnetic outer shell 3 against heat and against the mechanical operations such as lifting and tilting. In FIG. 7, the connecting rods 21 are shown extending between the clamping members 8 and 5 and arranged around the outer circumference of the outer shell 3.

In FIG. 8 showing the cross section in detail of the connecting portion, an insulating ring 22 is inserted between the upper nut 27 fastening the connecting rod 21 and the flange of the upper ring member 7, and an insulating ring 23 is inserted in the annular hollow portion formed between the connecting rod 21 and the flange of the upper ring member 7 so as to cut off the formation of an electrical circuit between the connecting rod 21 and the upper ring member 7. Through the center of the connecting rod 21, a coolant path 24 is provided, the upper end of which is connected to a coolant supply pipe 25. The coolant passing through the path removes the connecting rod of the heat due to the induction and thereby maintains the required strength of the rod.

In this embodiment also, it is possible to provide a vacuum sealing structure when a sealing member 26 is used just as in the previous embodiment. Description in this connection is omitted because the arrangement is the same as in the previous embodiment.

Figure 9:
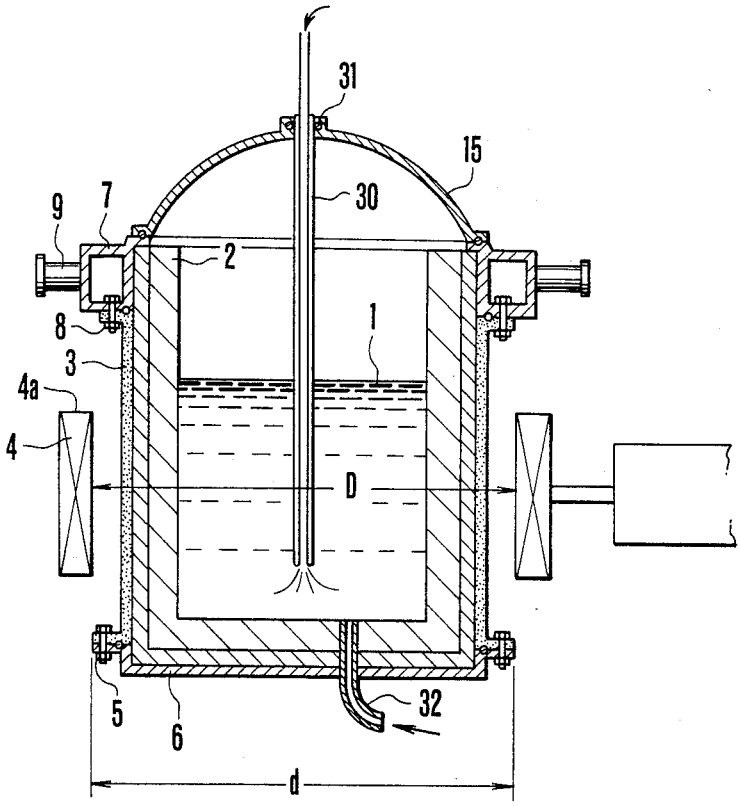
FIG. 9 shows the cross section of a still another embodiment of the apparatus according to the present invention.

FIG. 9 shows still another modification of the present invention, where the vessel 20 is a ladle, at the center of which a lance 30 for blowing gas or powder is provided extending through the vacuum hood 15 into the molten metal. The portion of the hood through which the lance extends is provided with a sealing member 31 so as to enable the refining of metal by induction heating under vacuum.

In this case, with substitution of or an addition of the lance 30, a bottom blowing tuyere 32 may be provided at a portion beneath the bath level, for example through the bottom of the layer so as to blow in the gas or powder therethrough.

When both the lance 30 and the bottom blowing tuyere 32 are used, the effect is a further increase in refining, therefore a higher degree of refinement of the metal can be achieved by the blowing of gas or powder and the induction heating in a vacuum.

Needless to say, the above embodiment can be applied to ordinary air-melt-treatments other than the vacuum treatment and either the lance 30 or the bottom blowing tuyere 32 can be used.

What we claim:

1. An induction heating apparatus, particularly useful for induction heating of molten metal, comprising:

a refractory vessel in which a charge to be heated is placed;

said vessel comprising a refractory lining and an outer shell covering the refractory lining and having strength high enough to sustain the lining;

an induction heating coil arranged spacedly around the outer circumference of said shell; and a bottom outer shell covering the bottom of said refractory lining, said outer shell having an outer diameter that is, at a position below the upper end of said coil, smaller than the inner diameter of said coil so as to enable the removal of said vessel through the upper side of said coil, at least part of said outer shell covering a height of the circumferential surface of said vessel corresponding to the height of said coil being made of a non-magnetic material, and said bottom outer shell being made of metal.

2. An induction heating apparatus according to claim 1, which further comprises a vacuum hood detachably mounted onto the upper end portion of said vessel.

3. An induction heating apparatus according to claim 1, which further comprises a lance for blowing gas or powder into the vessel through the upper portion thereof.

4. An induction heating apparatus according to claim 1, which further comprises a tuyere provided through the wall of said vessel at a level below the level of the molten bath contained therein for blowing gas or powder into the bath.

5. An induction heating apparatus according to claim 1, in which the height of the part of the circumferential outer shell made of a non-magnetic material is not less than the height of the induction coil.

6. An induction heating apparatus according to claim 5, in which the height of the part of the circumferential outer shell made of a non-magnetic material is not more than 4 times the height of the induction coil.

7. An induction heating apparatus according to claim 1, in which the non-magnetic material forming the part of the circumferential outer shell is a magnetic flux transmissible material selected from the group consisting of composite plastic materials reinforced with carbon fibres or glass fibres and composite asbestos materials reinforced with cement and ceramics.

* * * * *